United States Patent [19]

Sakai

[11] Patent Number: 4,972,793

[45] Date of Patent: Nov. 27, 1990

[54] ANCHOR

[75] Inventor: Tokio Sakai, Chiba, Japan

[73] Assignee: Sakai Kohatsu Kabushiki Kaisha, Chiba, Japan

[21] Appl. No.: 459,565

[22] Filed: Jan. 2, 1990

[30] Foreign Application Priority Data

Mar. 31, 1989 [JP] Japan ..... 1-80833

[51] Int. Cl.[5] ..... B63B 21/38

[52] U.S. Cl. ..... 114/304; 114/294

[58] Field of Search ..... 114/294, 295, 298, 301–309

[56] References Cited

U.S. PATENT DOCUMENTS

| | | | |
|---|---|---|---|
| 2,696,187 | 12/1954 | Pitzipio | 114/306 |
| 3,332,387 | 7/1967 | Winslow | 114/307 |
| 4,029,040 | 6/1977 | Klaren | 114/304 |
| 4,154,186 | 5/1979 | Haak | 114/304 |
| 4,469,042 | 9/1984 | Ogg | 114/304 |

*Primary Examiner*—Joseph F. Peters, Jr.
*Assistant Examiner*—Edwin L. Swinehart
*Attorney, Agent, or Firm*—Toren, McGeady & Associates

[57] ABSTRACT

An anchor is used for anchoring a hull or a floating body on the water. When the anchor of the present invention is made to land on the bottom of the water, left and right bills and a lower auxiliary bill encroach the bottom of the water and thus to make anchoring positive, and as a shank, bills and a bill stopping frame are relatively thin, said anchor is lighter than the conventional anchors. Consequently the resistance of the sediment in the bottom of the water is minimized with respect to the encroachment, and therefore the work and labor during casting and weighing said anchor can be relieved.

7 Claims, 6 Drawing Sheets

ANCHOR

BACKGROUND OF THE INVENTION

Conventional anchors include a Japanese anchor, in which bills (d) are formed in ends of arms (c) extending to opposite sides of a crown (b) formed at the extreme end of a shank (a), and a stock (e) perpendicular to the arms (c) is provided on the crown (b), as shown in FIGS. 6 to 8; a Western anchor, in which a stock (g) perpendicular to arms (f) is provided on a shank (h), as shown in FIGS. 9 to 11; a warship anchor, in which a rotatable bill shaft (j) is provided at the extreme end of a shank (i) so that the bill shaft (j) is perpendicular to and to be projected on opposite sides of the shank (i), a bill seat plate (1) having a window hole (k) in a central portion thereof is provided with both sides in a vertical central portion of the seat plate (1) secured to both sides of the bill shaft (j), and bills (m) perpendicular to the seat plate (1) are secured to the plate (1), as shown in FIGS. 12 to 14; and a Danforth anchor, in which a rotatable bill shaft (p) is provided at the extreme end of a shank (n) so that the bill shaft (p) is perpendicular to and to be projected on opposite sides of the shank (n), and two bills (q) which is triangular and of which extreme ends are close to each other are secured to opposite ends of a bill shaft (p), as shown in FIGS. 15–17.

Both the Japanese anchor and Western anchor have substantially the same shape and same performance. The shank is square or round in section and has a large area in contact with the ground and will not move into the sediment at the bottom of the water but only the bill enters the sediment at the bottom of the water. Therefore, an anchoring force is relatively small.

In the warship anchor, the shank is square in section to hold the weight and has a large area in contact with the ground and will not move into the sediment at the bottom of the water. In addition, the bill seat plate receives a resistance of the sediment and the force acts in a direction of floating the bill. Therefore, an anchoring force is also relatively small.

The Danforth anchor is provided with two bills which have a triangular shape which may easily enter the sediment at the bottom of the water. However, the extreme ends of the bills are close to each other, and therefore, in case where the sediment layer at the bottom of the water is hard or in case where seaweed is present at the bottom of the water, the bills are hard to move into the bottom of the water and tend to turn over. There involves a problem in that anchorage is not reliable.

In view of the foregoing, the present inventor has proposed an anchor as disclosed in a Japanese Patent Laid-Open Publication No. 110591/1985 which comprises two bills (s) having a larger surface area to strengthen the anchoring force, bill stopping frames (t) and a thin and wider shank (u) to facilitate the movement thereof into the sediment at the bottom of the water, as shown in FIGS. 18 to 20.

Furthermore, an anchor disclosed in a Japanese Patent Laid-Open Publication No. 69895/1976 comprises a shank, two bills pivoted to said shank and having a delta shape, a trimming plate or a head surface disposed on either bill, said trimming plate having a width narrower than the entire width of the bill. This is an anchor for anchoring a ship for particular purposes, a dredger, an offshore platform for boring, and the like, in which both outer ends of both the trimming plates are connected to the outer edges of the bills by means of stabilizing plates which close and form an acute angle by the direction of the shank and the surface of the bills.

In this anchor, the outer ends of both trimming plates are connected outer ends of triangular bills through stabilizing plates to thereby increase a stability of the anchor, which eliminates the need of a stock provided in a conventional Danforce type anchor, removing various problems such as an increase in width of the anchor because of the stock, a damage to the hull because of the stock, twining of a steel wire to the stock, etc. However, since the weight of a portion comprising the trimming plates frontwardly of a pivot pin, stabilizing plates and front portions of the triangular bills is substantially the same as the weight of a portion comprising rear portions of the triangular bills at the rear of the pivot pin, the triangular bills make a landing on the bottom in a substantially horizontal state. Therefore, the extreme ends of the triangular bills are hard to pierce into the bottom of the water. In case where the earth of the bottom of the water is hard, even if the anchor is pulled by an anchored object, the extreme ends of the triangular bills will not be pierced into the bottom of the water but possibly floated. Moreover, since the extreme ends of the left and right triangular bills are converged on the side of the shank, the extreme ends of the triangular bills are pierced into substantially the same place of the bottom of the water and moved therein. Therefore, the anchoring force of the anchor is small and is not sufficient in stability. When a lateral force acts on the shank due to the movement of an anchored object or a steel wire because of wind or waves, the anchor having been moved into the bottom of the water is possibly disengaged and turned over.

An anchor disclosed in a Japanese Patent Laid-Open Publication No 146392/1979 comprises a hook having two hook members, a shank hinged to said hook and a rear stabilizer, in which the shank is mounted between hook members to a hinge pin which is located substantially at the center of gravity of the entire construction of the hook by means of face plates which are interconnected at inner ends by means of flange plates and converged in a mutual direction from said inner ends to form a thin extreme end, a rear portion and a side end. The anchor further comprises a head plate mounted on the hook on each side of the hinge pin to limit a rotational angle of the hook and a blade plate towards the rear stabilizer located at the side corner of the hook from the head plate.

According to this anchor, two hook members of a closed hollow construction formed by the flange plate and two face plates are connected at inner ends by means of the flange plate and the head plate and the stabilizer located at the side corner of the hook are connected by the blade plate to thereby enhance the strength of the hook and increase the stability of the anchor. However, since the weight of a portion comprising the head plate frontwardly of the hinge pin, the blade plate, the stabilizer and the front portion of the hook member is substantially the same as the weight of a portion comprising the rear portion of the hook member at the rear of the hinge pin and since the finger-like extreme ends of the left and right hook members are converged on the shank side, the finger-like extreme ends of the hook members are hard to be pierced into the bottom of the water, the anchoring force of the anchor is small and the stability is not sufficient.

In the anchor according to the present invention, when making a landing on the bottom of the water, three parts, i.e., left and right bills and a lower auxiliary bill encroach the bottom of the water. Therefore, the anchorage is positive. In addition, the shank as well as the bill stopping frame are made thin in wall thickness, and therefore, the entire anchor encroaches the sediment of the bottom of the water, providing a great anchoring force.

Since the bill is wide and of the spread-open type, the anchor is prevented from being turned over. The inside of the bill stopping frame has a space, and therefore, the sediment can pass therethrough, minimizing the resistance of the sediment in the bottom of the water with respect to the encroachment. The anchorage of the anchor is quick and positive.

Since the shank, bills and bill stopping frame are thin, the anchor of the present invention is lighter than the conventional anchors, and the work and labor during casting an anchor can be relieved.

SUMMARY OF THE INVENTION

The present invention relates to anchors used for anchoring a hull or floating bodies on the water, and particularly to an anchor which is effective for anchorage in areas of sand and muddy bottom of the water.

An object of the present invention is to provide an anchor in which when making a landing on the bottom of the water, three parts, i.e., left and right bills and a lower auxiliary bill encroach the bottom of the water to make anchoring positive.

A further object of the present invention is to provide an anchor, in which a shank and a bill stopping frame are made thin, and the entire anchor encroaches the sediment in the bottom of the water to make anchoring great.

A still another object of the present invention is to provide an anchor in which bills are wide and of a spread open type to prevent the anchor from being turned over.

Another object of the present invention is to provide an anchor in which the inside of a bill stopping frame has a space to allow the passage of the sediment, thus minimizing a resistance of the sediment of the bottom of the water with respect to the encroachment, resulting in a quick and positive anchoring of the anchor.

Another object of the present invention is to provide an anchor in which a shank, bills and a bill stopping frame are all made thin in wall thickness to make an anchor lighter than conventional anchors, thus capable of relieving work and labor during casting an anchor.

DETAILED DESCRIPTION OF THE INVENTION

An embodiment of the present invention will be described in detail with reference to the drawings.

Figure 1:
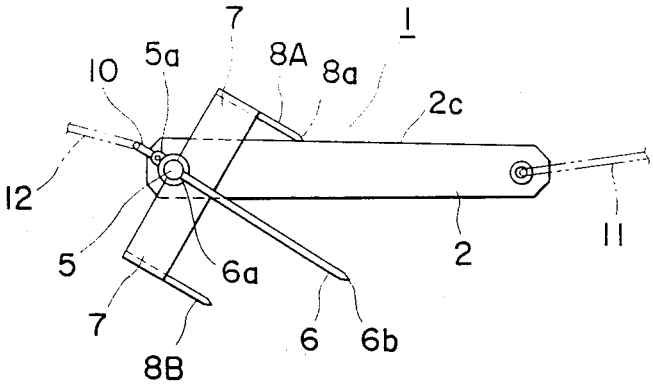
FIG. 1 is a front view of an anchor according to the present invention.
Figure 2:
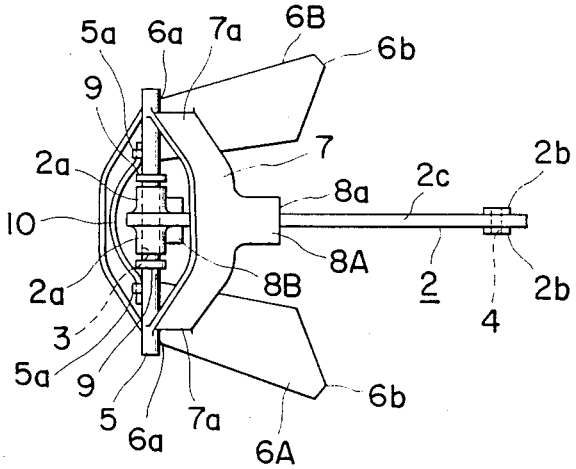
FIG. 2 is a plan view of an anchor according to the present invention.

An anchor 1 of the present invention has a shank 2 having a substantially rectangular section like a flat bar which is thin and wide and of which opposite sides comprise parallel vertical surfaces, as shown in FIGS. 1 and 2. The shank 2 is formed at opposite extreme ends with bosses **2*a* and 2*a* through which extend bill shaft inserting hole 3. The shank 2 is formed at both rear ends thereof with bosses 2*b* and 2*b* through which extend anchor rope mounting holes 4**.

A rotatable bill shaft 5 which is perpendicular to and to be projected on opposite sides of the shank 2 is inserted at its central portion into the bill shaft inserting hole 3.

Base portions **6*a* and 6*b* of left bill 6A and right bill 6B respectively extending in a horizontal direction along the shank 2 are secured to both end sides of the bill shaft 5, the left bill 6A and right bill 6B having their tip portions 6*b* and 6*b* gradually reduced in width. The left bill 6A and right bill 6B are of the spread-open type towards the tip portions 6*b* and 6*b***, each of which has the shape of a blade and also these bills are rearwardly extended like spreaded wings.

Both ends **7*a* and 7*b* of hexagonal thin bill stopping frame 7 are secured over the bill shaft 5 and the base portions 6*a* and 6*a* of the bills 6 and 6, the bill stopping frame 7 being perpendicular to the extending direction of the left bill 6A and right bill 6B. The bill stopping frame 7 is formed in the central portion thereof with an upper auxiliary bill 8A and a lower auxiliary bill 8B projected sideward, the upper auxiliary bill 8A and the lower auxiliary bill 8B being parallel to and horizontal to the left bill 6A and the right bill 6B, respectively, and having the length shorter than the length in the extending direction of the left bill 6A and the right bill 6B**.

The extreme end of the upper auxiliary bill 8A and the extreme end of the lower auxiliary bill 8B are engageable with the upper end edge **2*c* of the shank 2 in case where either the upper auxiliary bill 8A or the lower auxiliary bill 8B** comes to the upper position thereof.

Fitting rings 9 and 9 in contact with the bosses **2*a* and 2*b* are secured to the bill shaft 5 so that the bill shaft 5 is made immovable in a lateral direction by means of the fitting rings 9 and 9**.

Both ends of a raising rope stop ring 10 are rotatably mounted to supporting portions **5*a* and 5*a* provided on both sides of the bill shaft 5, and the projecting direction of the raising rope stop ring 10 is set in the extending direction of the left bill 6A and the right bill 6B**.

Accordingly, there is a phase difference by 90° between the left bill 6A and the right bill 6B and the upper portion of the bill stopping frame 7 and the lower portion of the bill stopping frame 7 around the bill shaft 5, so that when the tip portion 8*a* of the upper auxiliary bill 8A comes into contact with the upper end surface 2*c* of the shank 2, the rotation of the bill shaft 5 is impeded in the state where the left bill 6A and the right bill 6B and the upper auxiliary bill 8A and the lower auxiliary bill 8B are held at a predetermined angle with respect to the shank 2.

One end of an anchor rope 11 is tied to the anchor rope mounting hole 4, and one end of a raising rope 12 is tied to the raising rope stop ring 10.

Figure 3:
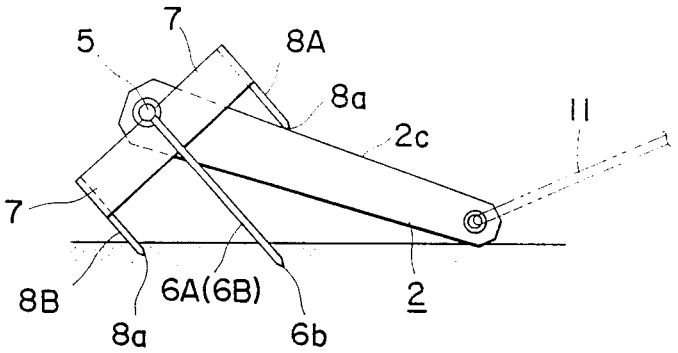
FIG. 3 is an explanatory view showing a state where an anchor according to the present invention makes a landing on the bottom of the water.
Figure 4:
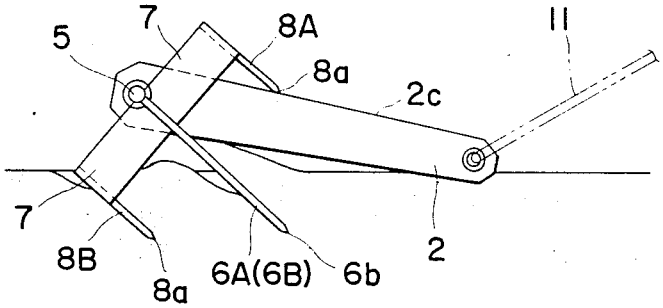
FIG. 4 is an explanatory view showing a state where an anchor rope starts to be tensioned in an anchor according to the present invention.
Figure 5:
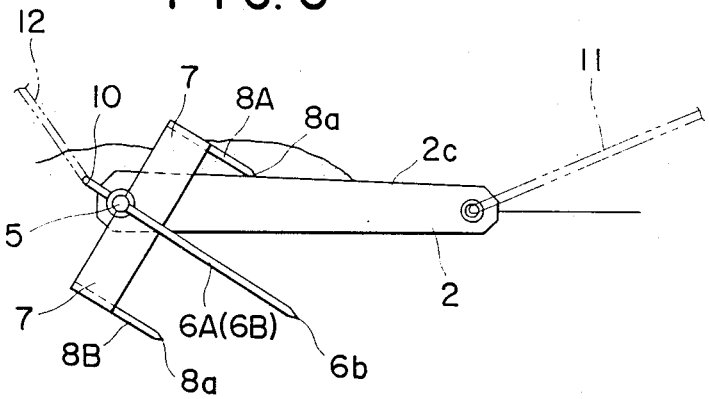
FIG. 5 is an explanatory view showing a state in which an anchor according to the present invention is set.
Figure 6:
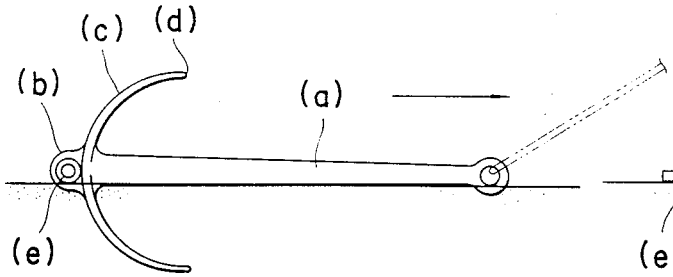
PRIOR ART FIG. 6
FIG. 6 is a front view of a Japanese anchor.
Figure 8:
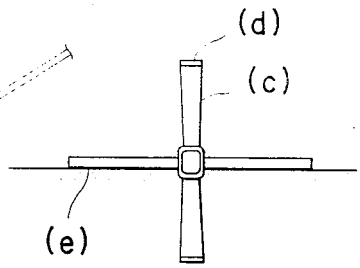
PRIOR ART FIG. 8
FIG. 8 is a side view of the Japanese anchor.
Figure 7:
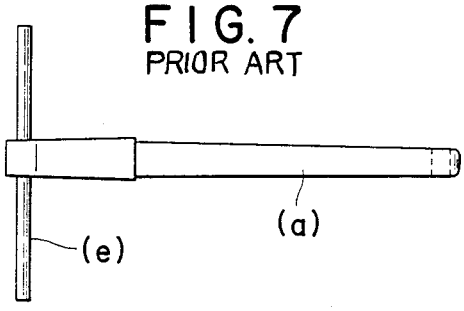
FIG. 7 PRIOR ART
FIG. 7 is a plan view of the aforesaid anchor.
Figure 9:
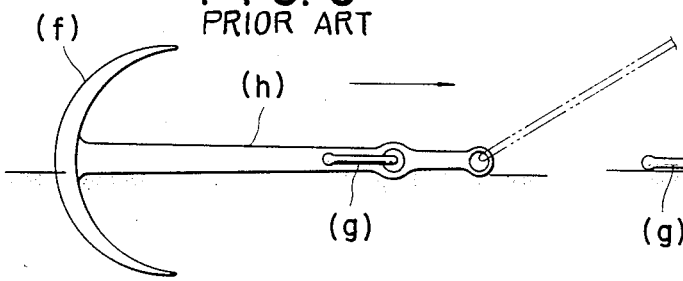
FIG. 9 PRIOR ART
FIG. 9 is a front view of a Western anchor.
Figure 11:
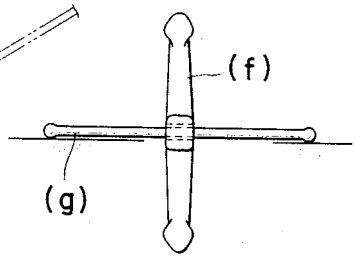
PRIOR ART FIG. 11
FIG. 11 is a side view of the Western anchor.
Figure 10:
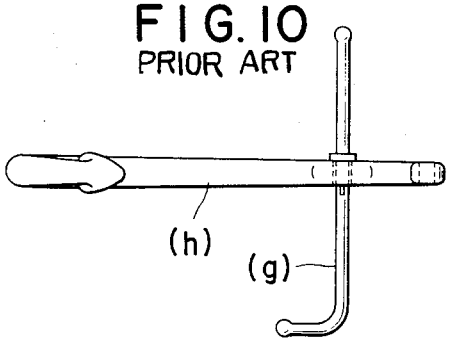
FIG. 10 PRIOR ART
FIG. 10 is a plan view of the Western anchor.
Figure 12:
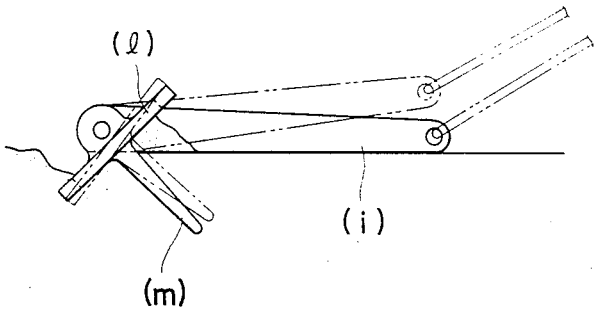
PRIOR ART FIG.12
FIG. 12 is a front view of a warship anchor.
Figure 14:
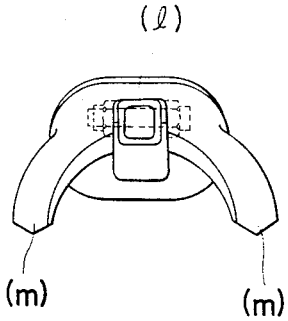
PRIOR ART FIG.14
FIG. 14 is a side view of the warship anchor.
Figure 13:
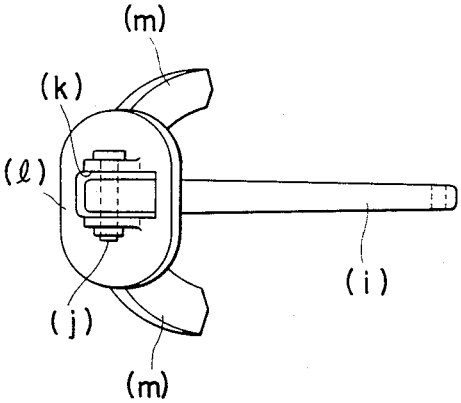
PRIOR ART FIG.13
FIG. 13 is a plan view of the warship anchor.
Figure 15:
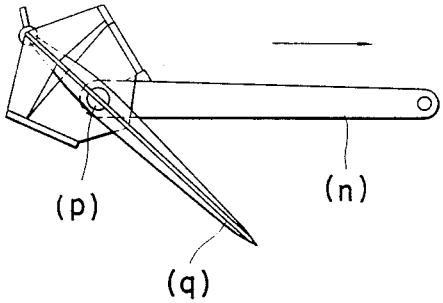
PRIOR ART FIG. 15
FIG. 15 is a front view of a Danforth anchor.
Figure 17:
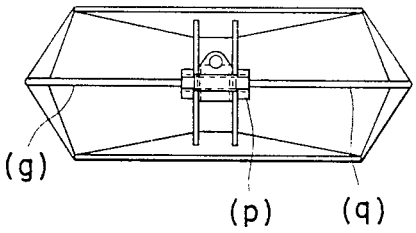
PRIOR ART FIG. 17
FIG. 17 is a side view of the Danforth anchor.
Figure 16:
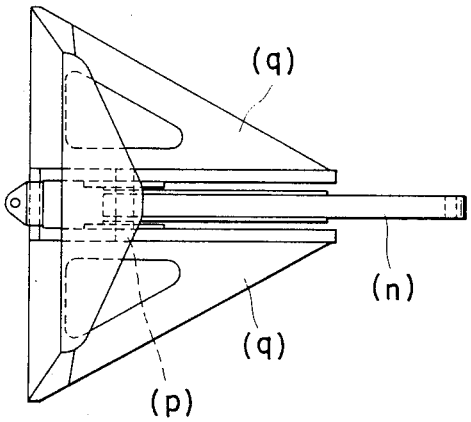
PRIOR ART FIG. 16
FIG. 16 is a plan view of the Danforth anchor.
Figure 18:
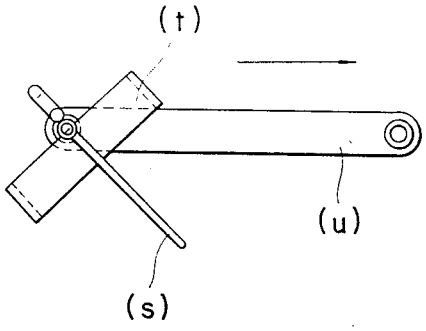
PRIOR ART FIG.18
FIG. 18 is a front view of an anchor according to the invention of the present inventor disclosed in the Japanese Patent Laid-Open Publication No. 110591/1985.
Figure 20:
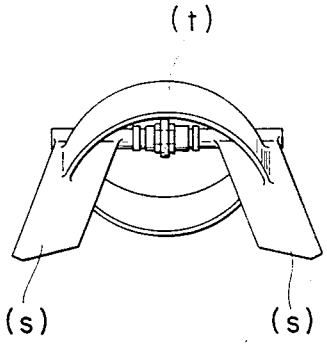
PRIOR ART FIG.20
FIG. 20 is a side view of the anchor according to the invention of the present inventor.
Figure 19:
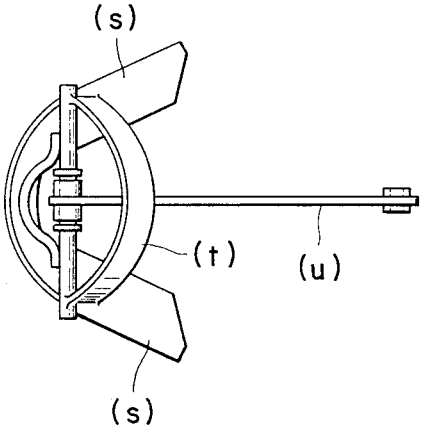
PRIOR ART FIG.19
FIG. 19 is a plan view of the anchor according to the invention of the present inventor.

The anchor 1 according to the present invention is constructed as described above. As shown in FIG. 3, in the state where the anchor makes a landing on the bottom of the water, the tip portions 6*b* and 6*b* of the left bill 6A and the right bill 6B, respectively, slightly encroach the bottom of the water and the tip portion 8*a* of lower auxiliary bill 8B slightly encroaches the bottom of the water. When the anchor rope 11 starts to tension, the left bill 6A and the right bill 6B and the lower auxiliary bill 8B further deeply encroach the sediment in the bottom of the water and in addition the lower bill stopping frame 7 also encroaches the sediment in the bottom of the water, as shown in FIG. 4. When the anchor rope 11 is tensioned, the bill stopping frame 7 and the shank 2 also encroach the sediment in the bottom of the water, and as a result, the anchor 1 assumes its set position.

The sediment digged by the left bill 6A, the right bill 6B and the lower auxiliary bill 8B passes through the space surrounded by the bill stopping frame 7 to easily cross over the bill shaft 5 whereby the encroachment of the left bill 6A, the right bill 6B and the lower auxiliary bill 8B into the sediment in the bottom of the water is not impeded. Since the bill stopping frame 7 and the shank 2 are thin in wall thickness, they may be easily moved into the sediment in the bottom of the water. Accordingly, the anchor 1 deeply encroaches the sediment in the bottom of the water, and the anchoring force thereof is great.

In raising the anchor, the raising rope 12 is pulled up whereby the left bill 6A, the right bill 6B, the upper auxiliary bill 8A, the lower auxiliary bill 8B and the bill stopping frame 7 can be pulled in the direction opposite to the encroaching direction to be easily pulled out of the sediment in the bottom of the water.

The anchor 1 according to the present invention ensures the positive anchorage and sufficient anchoring force even for the rocky ground as well as the sand ground because the left bill 6A, the right bill 6B, the upper auxiliary bill 8A and the lower auxiliary bill 8B can move under pressure into crevices of a rock bed and a ledge.

While in the present embodiment, the bill stopping frame has been in the form of a hexagonal ring, it is to be noted that the frame may be of a polygonal ring in place thereof or an annular ring.

According to the anchor of the present invention, in the state where the anchor makes a landing on the bottom of the water, the tip portion of the bills slightly encroach the bottom of the water, and the tip portion of the auxiliary bill also slightly encroaches the bottom of the water. When the anchor rope begins to tension, the bills and the auxiliary bill further deeply encroach the sediment in the bottom of the water, and in addition, the bill stopping frame and the shank also encroach the sediment in the bottom of the water, after which the anchor assumes its set state.

What is claimed is:

1. An anchor comprising a shank which is thin in wall thickness and wide in width and extending lengthwise, a rotatable bill shaft provided at the extreme end of said shank so that said bill shaft is perpendicular to and to be projected on both sides of said shank, a left bill and a right bill having base portions secured to both ends of said bill shaft, said left and right bills having a rearwardly extending wing-like shape a bill stopping frame which is thin in wall thickness and which has a ring shape provided perpendicular to the extending direction of said bills, said bill stopping frame having both ends secured to the bill shaft corresponding to base portions of said bills, and an upper auxiliary bill and a lower auxiliary bill which are projected from side ends of said bill stopping frame, parallel to the extending direction of said bills, said upper and lower auxiliary bills having extreme ends engagaeable with edges of the shank.

2. An anchor comprising a shank which is thin in wall thickness and wide in width and extending lengthwise, said shank having sides in the form of parallel surfaces, a rotatable bill shaft provided at the extreme end of said shank so that said bill shaft is perpendicular to and to be projected on both sides of said shank, a left bill and a right bill having base portions secured to both ends of said bill shaft, said left and right bills having a rearwardly extending wing-like shape, shape, a bill stopping frame which is thin in wall thickness and which has a ring shape provided perpendicular to the extending direction of said bills, said bill stopping frame having both ends secured to the bill shaft corresponding to base portions of said bills, and an upper auxiliary bill and a lower auxiliary bill which are projected from side ends of siad bill stopping frame, parallel to the extending direction of said bills and shorter in length than the extending length of said bills, said upper and lower auxiliary bills having extreme ends engageable with edges of the shank.

3. An anchor comprising a shank which is thin in wall thickness and wide in width and extending lengthwise, said shank having sides in the form of parallel surfaces like a flat bar, a rotatable bill shaft provided at the extreme end of said shank so that said bill shaft is perpendicular to and to be projected on both sides of said shank, a left bill and a right bill having base portions secured to both ends of said bill shaft said left and right bills having a rearwardly extending wing-like shape, a bill stopping frame which is thin in wall thickness and which has a ring shape provided perpendicular to the extending direction of said bills, said bill stopping frame having both ends secured to the bill shaft corresponding to base portions of said bills, and an upper auxiliary bill and a lower auxiliary bill which are projected from the side ends of said bill stopping frame, parallel to the extending direction of said bills and shorter in length than the extending length of said bills, said upper and lower auxiliary bills having the extreme ends engageable with the edge of the shank, in which there is a phase difference by 90° between the left bill and the right bill and the upper portion of the bill stopping frame and the lower portion of the bill stopping frame around the bill shaft, so that when a tip portion of the upper auxiliary bill comes into contact with the edge of the shank, the rotation of the bill shaft is impeded in the state where the left bill and the right bill and the upper auxiliary bill and the lower auxiliary bill are held at a predetermined angle with respect to the shank.

4. An anchor comprising a shank which is thin in wall thickness and wide in width and extending lengthwise, said shank having sides in the form of parallel surfaces and having an anchor rope capable of being tied to a rear end thereof, a rotatable bill shaft provided at the extreme other end of said shank so that said bill shaft is perpendicular to and to be projected on both sides of said shank, a left bill and a right bill having base portions secured to both ends of said bill shaft, said left and right bills having a rearwardly extending wing-like shape, a raising rope stop ring having both ends rotatably mounted on said bill shaft, a bill stopping frame which is thin in wall thickness and which has a ring shape provided perpendicular to the extending direction of said bills, said bill stopping frame having both ends secured to the bill shaft corresponding to the base portions of said bills, and an upper auxiliary bill and a lower auxiliary bill which are projected from the side ends of said bill stopping frame, parallel to the extending direction of said bills and shorter in length than the extending length of said bills, said upper and lower auxiliary bills having extreme ends engageable with edges of the shank.

5. An anchor comprising a shank which is thin in wall thickness and wide in width and extending lengthwise, said shank having sides in the form of parallel surfaces like a flat bar and having an anchor rope mounting hole at a rear end thereof, a rotatable bill shaft provided at the other end of said shank so that said bill shaft is perpendicular to and to be projected on both sides of said shank, a left bill and a right bill having base portions secured to both ends of said bill shaft, said left and right bills having a rearwardly extending wing-like shape, said bill shaft having a raising rope stop ring mounted thereon, a bill stopping frame which is thin in wall thickness and which has a ring shape provided perpendicular to the extending direction of said bills, said bill stopping frame having both ends secured to the bill shaft corresponding to the base portions of said bills, and an upper auxiliary bill and a lower auxiliary bill which are projected from side ends of said bill stopping frame, parallel to the extending direction of said bills and shorter in length than the extending length of said bills, said upper and lower auxiliary bills having extreme ends engageable with edges of the shank.

6. The anchor according to one of claims 1, 2, 3, 4 and 5, wherein said bill stopping frame is in the form of a hexagonal ring.

7. The anchor according to one of claims 1, 2, 3, 4 and 5, wherein said bill stopping frame is in the form of a polygonal ring.

* * * * *